US011666111B2

(12) United States Patent
Pracht

(10) Patent No.: US 11,666,111 B2
(45) Date of Patent: Jun. 6, 2023

(54) HEAD PROTECTION SYSTEM

(71) Applicant: Dräger Safety AG & Co. KGaA, Lübeck (DE)

(72) Inventor: Steffen Pracht, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 267 days.

(21) Appl. No.: 17/097,909

(22) Filed: Nov. 13, 2020

(65) Prior Publication Data

US 2021/0145107 A1 May 20, 2021

(30) Foreign Application Priority Data

Nov. 20, 2019 (DE) ..... 10 2019 008 043.2

(51) Int. Cl.

| | |
|---|---|
| ***A42B 3/14*** | (2006.01) |
| ***A42B 3/04*** | (2006.01) |
| ***A42B 3/28*** | (2006.01) |
| ***A62B 17/00*** | (2006.01) |
| ***A42B 7/00*** | (2006.01) |

(52) U.S. Cl.
CPC ..... *A42B 3/142* (2013.01); *A42B 3/0406* (2013.01); *A42B 3/283* (2013.01); *A42B 7/00* (2013.01); *A62B 17/003* (2013.01)

(58) Field of Classification Search
CPC ..... A42B 1/0186; A42B 1/0187; A42B 3/085; A42B 3/142; A42B 3/28; A42B 3/283; A42B 3/288; A62B 17/003
See application file for complete search history.

(56) References Cited

U.S. PATENT DOCUMENTS

| | | | | |
|---|---|---|---|---|
| 10,595,580 | B1 * | 3/2020 | Wilke | F41H 1/00 |
| 2004/0019957 | A1 | 2/2004 | Lewis et al. | |
| 2021/0321708 | A1 * | 10/2021 | Coursimault | A42B 3/142 |
| 2021/0337915 | A1 * | 11/2021 | Franke | A42B 3/324 |

FOREIGN PATENT DOCUMENTS

| | | | |
|---|---|---|---|
| DE | 8714490 | U1 | 9/1988 |
| DE | 19755085 | A1 | 6/1999 |
| DE | 202005013635 | U1 | 12/2005 |
| EP | 1885209 | B1 | 9/2010 |
| EP | 2716175 | A1 | 4/2014 |
| KR | 100989524 | B1 | 10/2010 |
| WO | 2006129028 | A1 | 12/2006 |
| WO | 2018/057976 | A1 | 3/2018 |

* cited by examiner

*Primary Examiner* — Katherine M Moran
(74) *Attorney, Agent, or Firm* — McGlew and Tuttle, P.C.

(57) ABSTRACT

A head protection system includes a safety helmet and a fire protection cloth. The safety helmet includes a helmet shell (105) and a holding device (108) to guarantee a distance (A) between a helmet shell inner side (106) and the user head (102). An air path (110) is formed by a plurality of openings (120) of a fastening ring (125) and the distance between the inner side of the helmet shell and the head of the user. The fastening ring is arranged at least in an area of the user forehead of the user. The fire protection cloth has a fastening strap (230) with rigid fastening elements (235) configured to mesh with an opening of the fastening ring to detachably fasten the fire protection cloth to the safety helmet. The rigid fastening elements fill the plurality of openings in the fastened state to close the air path.

10 Claims, 5 Drawing Sheets

HEAD PROTECTION SYSTEM

CROSS REFERENCE TO RELATED APPLICATIONS

This application claims the benefit of priority under 35 U.S.C. § 119 of German Application 10 2019 008 043.2, filed Nov. 20, 2019, the entire contents of which are incorporated herein by reference.

TECHNICAL FIELD

The present invention pertains to a head protection system with a safety helmet and with a fire protection cloth.

TECHNICAL BACKGROUND

It is known that a fire protection cloth may be used in the area of the back of the neck in addition to a firefighter helmet for protection from hot materials, radiant heat and flames. A special form of such a fire protection cloth, also called shawl collar or integral collar, additionally protects sensitive areas such as the forehead, parts of the face and the front and side areas of the neck. Combined with a gas mask, a fully enclosing protection of the head can be achieved for a firefighter.

Prior-art fire protection cloths are attached to the corresponding helmet, for example, to the firefighter helmet, by a Velcro fastener, by snap fasteners or by plastic clamps provided specifically for that purpose.

EP 1 885 209 B1 describes an integral collar, which can be connected to a safety helmet by means of two clamps made of an elastically deformable material by means of hooking devices.

SUMMARY

An object of the present invention is to make possible an improved head protection system, especially a head protection system with high wear comfort and with a high level of safety for the user of the head protection system.

A head protection system with a safety helmet and with a fire protection cloth is proposed according to the present invention to accomplish this object.

The safety helmet has a helmet shell and a holding device to guarantee a distance between an inner side of the helmet shell and the head of a user of the safety helmet in the state in which the safety helmet is being used. An air path results between the safety helmet and the head based on the distance between the inner side of the helmet shell and the head of the user, the air path being formed in part by a plurality of openings of a fastening ring, and the fastening ring being arranged at least in the area of the forehead of the user in the state in which the safety helmet is being used.

The fire protection cloth has a fastening strap, wherein the fastening strap has a plurality of rigid fastening elements, which are configured each to mesh with a respective opening of the fastening ring and thereby fasten the fire protection cloth detachably to the safety helmet. The plurality of rigid fastening elements fills the plurality of openings in the fastened state such that the air path is closed by the plurality of openings.

It was found within the framework of the present invention that it is advantageous for the use of the safety helmet without fire protection cloth if the head is adequately ventilated, whereas very hot air should be avoided on the inner side of the helmet shell during the firefighting when the fire protection cloth is being simultaneously used. Furthermore, it was found that the fire protection cloth can close openings for ventilation at the helmet shell in addition to the known protective functions for the head.

The head protection system according to the present invention thus advantageously makes possible an especially good ventilation of the head of a user of the safety helmet via the air path provided as long as no fire protection cloth is fastened to the safety helmet. Furthermore, the head protection system according to the present invention makes possible a reliable protection of the head from hot ambient air by the safety helmet and the fire protection cloth based on the closing of the plurality of openings and by the at least partial closing of the air path, which closing is made possible thereby.

Furthermore, the head protection system according to the present invention advantageously has mutually coordinated components, namely, the fastening ring of the safety helmet and the fastening strap of the fire protection cloth. These two components interact according to the present invention by the fact that fastening of the fire protection cloth via the fastening strap at the fastening ring causes the air path through the plurality of openings to be closed.

Closing of the openings means according to the present invention that these openings are essentially closed for the air path. The air path may also be formed according to the present invention over other paths in addition to through these openings on the inner side of the helmet shell, so that the closing of the plurality of openings leads to an at least partial reduction of air within the air path.

The safety helmet according to the present invention is especially a firefighter helmet. The advantages of the present invention are especially relevant for the use of the head protection system in areas with hot ambient air, i.e., especially for the use within the framework of the firefighting activity.

The air path is formed according to the present invention, among other things, by the plurality of openings of the fastening ring. The air path preferably comprises here a plurality of air path areas, wherein an air path area is associated with each opening. The plurality of air path areas may be configured as contiguous or non-contiguous areas.

In addition to the plurality of rigid fastening elements, additional components of the fastening strap and/or of the fastening ring may be provided in order to make possible a reliable fastening of the fastening strap at the fastening ring.

According to the present invention, a rigid fastening element is a fastening element that is suitable for closing a particular opening based on its rigid structure while it is being fastened in the area of the openings. In particular, the rigid fastening element may be arranged directly in front of a respective opening in the fastened state of the fire protection cloth at the safety helmet and contribute based on a tensioning force acting thereby on the fastening strap to the fastening of the fastening strap at the safety helmet. The rigid fastening elements are typically complemented here by additional components of the fastening strap and/or of the fastening ring, which likewise contribute to a reliable fastening of the fastening strap at the fastening ring.

The fastening ring may also be formed exclusively in the area of the forehead of the user, in which case an additional fastening part is then provided at the safety helmet in the area of the back of the head of the user in order to ensure a stable fastening of the fire protection cloth at the safety helmet. The fastening ring may have, in particular, a multipart configuration.

The holding device within the safety helmet according to the present invention is formed typically by a hair net and/or by a suitable strap on the inner side of the helmet shell. Corresponding holding devices have been known for many types of helmets for a long time and they will not therefore be explained in detail below.

The filling of an opening by a fastening element may be achieved, for example, by covering the opening by the fastening element or by passing the fastening element through the opening.

Preferred embodiments of the head protection system according to the present invention will be described below.

In an especially preferred embodiment, the fastening strap is manufactured from a plastic. A plastic is typically easy to process. As a result, the fastening strap can be manufactured in an especially favorable manner in this embodiment. The fastening strap is preferably a non-stretchable fastening strap, especially an essentially rigid fastening strap. Even though the essentially rigid fastening strap can be bent within the framework of folding up the fire protection cloth, it is not stretchable in the lateral direction, i.e., in the direction in which the fastening strap extends.

In an especially preferred embodiment, the safety helmet further has a shock-absorbing element, which is arranged on the inner side of the helmet shell. In an advantageous variant of this embodiment, the fastening ring is arranged at the shock-absorbing element. Due to the structure proposed in this variant, the openings of the fastening ring advantageously lead to under the shock-absorbing element and thus into the air path between the inner side of the helmet shell and the head of the user.

In another preferred embodiment, the fastening ring has at least four openings and especially at least six openings. An especially good ventilation of the head can be made possible hereby in case a fire protection cloth is not fastened.

In an advantageous embodiment of the head protection system according to the present invention, the fastening strap of the fire protection cloth is to be fastened at the fastening ring of the safety helmet via a latching mechanism. A latching mechanism is an at least positive-locking connection, preferably a positive-locking and non-positive connection. The latching mechanism is formed here by the rigid fastening elements of the fastening strap and by the fastening ring, at which the fastening strap is to be detachably fastened. In an alternative and/or additional embodiment, the fastening strap is additionally fastened to the fastening ring via an additional fastening mechanism. The additional fastening mechanism is, for example, a snap fastener mechanism, an at least non-positive latching mechanism and/or a click connection.

In an advantageous embodiment, the fastening elements form teeth at the fastening strap. An especially stable fastening of the fastening strap to the fastening ring can be made possible by means of such teeth. Furthermore, such teeth make possible an especially uniform fastening of the fastening strap at the fastening ring and hence also a uniform application of force in case of a pulling force acting on the fire protection cloth.

In an advantageous embodiment, the fastening elements of the fastening strap have an essentially rectangular configuration. In an alternative or additional embodiment, the fastening elements have an oval, triangular and/or semicircular configuration. In one variant of this embodiment, the opening of the plurality of openings, which said opening is associated with a respective fastening element, does advantageously likewise have an essentially rectangular, oval, triangular and/or semicircular configuration. The respective fastening element can thus reliably close the respective opening of the plurality of openings. Furthermore, the shapes of the openings according to this embodiment allow large openings compared to concave shapes, so that an especially good ventilation of the head is possible in case a fire protection cloth is not fastened to the safety helmet.

In another embodiment, the fastening elements and/or the openings have different shapes among each other. As a result, an especially effective air path, especially an air path with especially good ventilation of the head, can be made possible hereby depending one the shape of the safety helmet.

In an especially preferred embodiment, the fire protection cloth is a shawl collar. The head of the user of the head protection system can be protected hereby especially effectively from flames and from hot ambient air.

In an especially preferred embodiment, the safety helmet is configured such that the air path between the safety helmet and the head is completely closed in the fastened state of the fire protection cloth. It can be ensured hereby in an especially reliable manner that hardly any ambient air can pass through the openings to the inner side of the helmet shell in case a fire protection cloth is fastened to the safety helmet. The safety helmet is a firefighter helmet in an especially advantageous variant of this embodiment.

In another advantageous embodiment, the fastening strap comprises, in addition to the plurality of rigid fastening elements, a plurality of fastening parts, which are configured to detachably fasten the fire protection cloth to the safety helmet. The plurality of fastening parts preferably form a robust, reliable fastening, which is only complemented by the plurality of rigid fastening elements. The plurality of fastening parts are not formed preferably in the immediate vicinity of the plurality of openings. As a result, fastening via the fastening parts can be especially reliable. The fastening via the fastening parts requires corresponding fastening areas at the fastening ring. A corresponding fastening part and a corresponding fastening area are coordinated here with one another such that a positive-locking connection, preferably a positive-locking and/or non-positive connection, is possible between the fastening part and the fastening area. In an especially preferred variant of this embodiment the plurality of rigid fastening elements makes possible an especially simple and suitable arrangement of the fire protection cloth at the safety helmet, but it is only the plurality of fastening parts that effectively fasten the fire protection cloth at the safety helmet when pulling forces occur. The plurality of rigid fastening elements make it possible in this variant to secure the position of the fire protection cloth relative to the safety helmet when transverse forces occur. Transverse forces are forces with a component in the direction of the lateral extension of the fastening strap.

The fastening strap is preferably manufactured as a one-part fastening strap, especially in one part from a plastic. In an alternative advantageous embodiment, the fastening strap has a two-part configuration, especially a two-part configuration made of a plastic. The provision of two parts makes it advantageously possible to adapt the fire protection cloth to different head sizes.

The present invention shall be explained now in more detail on the basis of advantageous exemplary embodiments shown schematically in the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
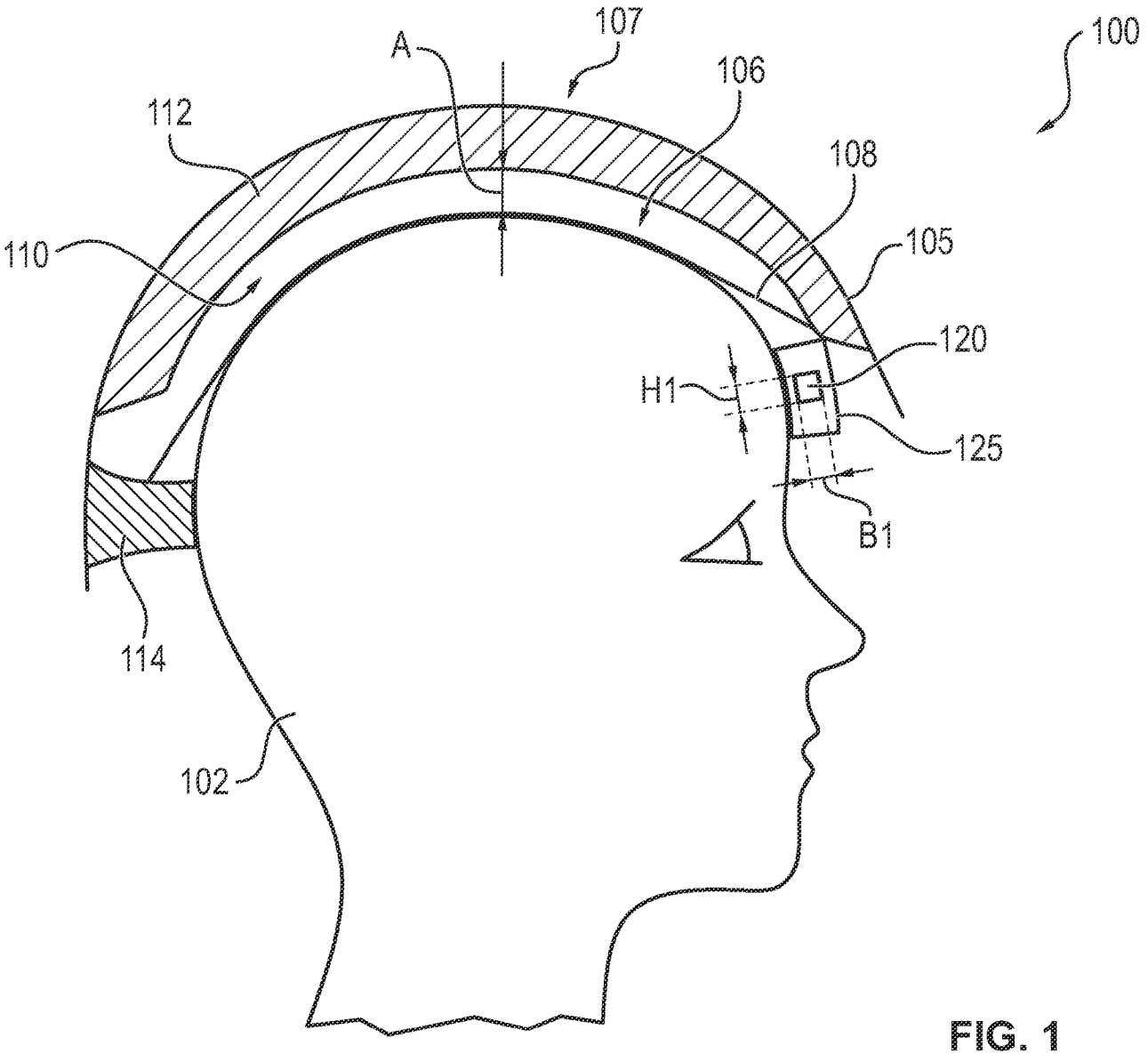
FIG. 1 is a schematic view of a safety helmet according to a first exemplary embodiment of a head protection system according to the present invention.

Referring to the drawings, FIG. 1 shows a schematic view of a safety helmet 100 according to a first exemplary embodiment of a head protection system according to the present invention.

The safety helmet 100 has a helmet shell 105 and a holding device 108 to guarantee a distance between an inner side 106 of the helmet shell 105 and the head 102 of a user of the safety helmet 100 in the state in which the safety helmet 100 is being used. The outer side 107 of the helmet shell 105 is formed without any openings in order to guarantee a protective function against hot materials, hot ambient air and flames. Based on the distance A between the inner side 106 of the helmet shell 105 and the head 102 of the user, an air path 110 is formed between the safety helmet 100 and the head 102. This air path 110 is formed in part by a plurality of openings 120 of a fastening ring 125. The guiding of the air within the air path 110 may be configured differently depending on the thermal conditions in the surrounding area. The air path 110 passes in this case through the holding device 108 formed by a suitable strapping and is limited only in part by the plurality of openings 120. In particular, the air path in the area of the forehead of the head 102 is not limited exclusively by the fastening ring 125, so that the air can escape freely from the air path 110 at the forehead.

The fastening ring 125 is arranged at least in the area of the forehead of the user in the state in which the safety helmet is being used. In the exemplary embodiment shown, the fastening ring 125 is formed only in the area of the forehead and is arranged at a shock-absorbing element 112, which is fastened to the inner side 106 of the helmet shell 105. The fastening ring 125 is bonded here to the shock-absorbing element 112. In one exemplary embodiment, not shown, the fastening ring is fastened to the shock-absorbing element or directly to the helmet shell in a non-positive and/or positive-locking manner.

The openings 120 of the plurality of openings have a rectangular shape in the exemplary embodiment shown. A respective opening has a width B1 of at least 0.3 cm, especially at least 0.5 cm, and especially preferably at least 1 cm. Furthermore, a respective opening has a height H1 of at least 0.3 cm, especially at least 0.5 cm, and especially preferably at least 1 cm.

In addition to the holding device 108, a spacer element 114 is arranged at the helmet shell 105 in the area of the back of the head, said spacer element ensuring that the helmet shell 105 does not strike in this area the head 102 of the user of the safety helmet 100. The distance A shown is the shortest distance between the inner side 106 of the helmet shell 105 and the head 102. In the exemplary embodiment shown, the distance A is at least 0.3 cm, especially at least 0.7 cm and especially preferably at least 1.3 cm.

The head protection system is used according to the present invention in the state shown without fire protection cloth if the user would not currently like to protect himself from hot ambient air and is therefore interested in an air stream through the air path 110. Such an air stream can, for example, carry stagnant heat present on the inner side 106 of the helmet shell 105 away from the user. Furthermore, the air stream can bring about cooling of the head 102 of the user.

Figure 2:
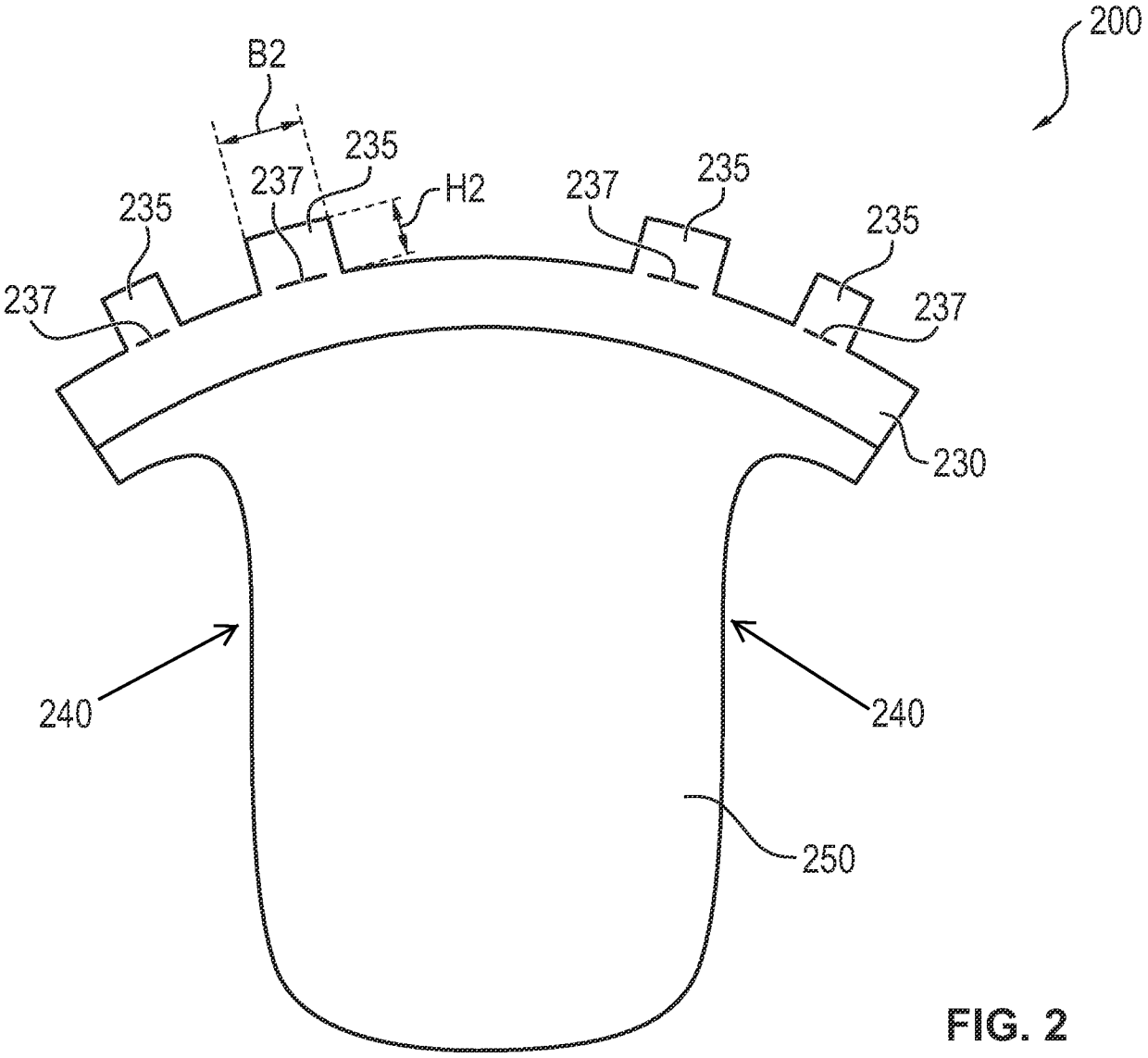
FIG. 2 is a schematic top view of a fire protection cloth according to the first exemplary embodiment of the head protection system according to the present invention.

FIG. 2 shows a schematic view of a fire protection cloth 200 according to the first exemplary embodiment of the head protection system according to the present invention.

The fire protection cloth 200 has a fastening strap 230. The fastening strap 230 has a rigid configuration. The fastening strap 230 has a rigid configuration due to the fact that it is not stretchable in the lateral direction, i.e., in the direction of the extension of the fastening strap 230. The fastening strap 230 is manufactured in this case from a plastic and can be bent in the transverse direction. Such a bending is advantageous for not occupying too much space during the storage of the fire protection cloth 200 and for the fire protection cloth to be nevertheless able to be fastened to a safety helmet. The fastening strap 230 has a plurality of rigid fastening elements 235, which are configured each to mesh with a respective opening 120 of the fastening ring 125 and thereby to detachably fasten the fire protection cloth 200 at the safety helmet 100. The fastening elements 235 have a respective projection 237 in this case, via which a respective fastening element 235 can be fastened at a respective opening 120. The fastening strap 230 in the exemplary embodiment shown has a one-part configuration, the two ends being arranged in the area of the forehead of the head of the user 102. Recesses 240 are correspondingly arranged in the fire protection cloth 200 for the face of the user in opposite edge areas of the textile part 250 proper of the fire protection cloth 200.

The fastening strap 230 is sewn to the textile part 250. In one exemplary embodiment, not shown, the fastening strap is connected to the textile part by bonding.

The plurality of rigid fastening elements 235 are coordinated with the structure of the safety helmet 100 such that the plurality of openings 120 are filled in the fastened state by the fastening elements 235 such that the air path through the plurality of openings is closed.

In the exemplary embodiment shown, the fastening strap 230 comprises exactly four rigid fastening elements 235. In one exemplary embodiment, not shown, the head protection system comprises more than four openings, especially at least six openings and a corresponding number of rigid fastening elements.

The rigid fastening elements 235 in the exemplary embodiment shown have an essentially rectangular configuration and are especially suitable as a result for filling out the corresponding, essentially rectangularly configured openings 120 at the fastening ring 125. Such a filling is brought about in this case by a respective fastening element 235 passing through an opening 120 provided for that purpose and by the fastening element 235 snapping correspondingly into that opening 120 due to the corresponding projection 237. The respective, essentially rectangular, rigid fastening element 235 of the plurality of fastening elements has a width B2 of at least 0.3 cm, especially at least 0.5 cm and especially preferably at least 1 cm. Further, the respective, essentially rectangular, rigid fastening elements 235 has a height H2 of at least 0.3 cm, especially at least 0.5 cm and especially preferably at least 1 cm.

The fastening strap 230 has a thickness of at least 1 mm and especially at least 1.5 mm.

The safety helmet 100 and the fire protection cloth 200 from FIG. 1 and from FIG. 2 are coordinated with one another and form a common head protection system according to the present invention. Within the framework of the exemplary embodiments shown in FIGS. 3 through 5, the safety helmet and the fire protection cloth are shown in a state in which they are fastened to one another, a front area of the corresponding helmet shell of the safety helmet being always shown in a shortened form in order to make it possible to show in a suitable manner the fastening of the respective fire protection cloth at the respective safety helmet and the position of the plurality of openings.

Figure 3:
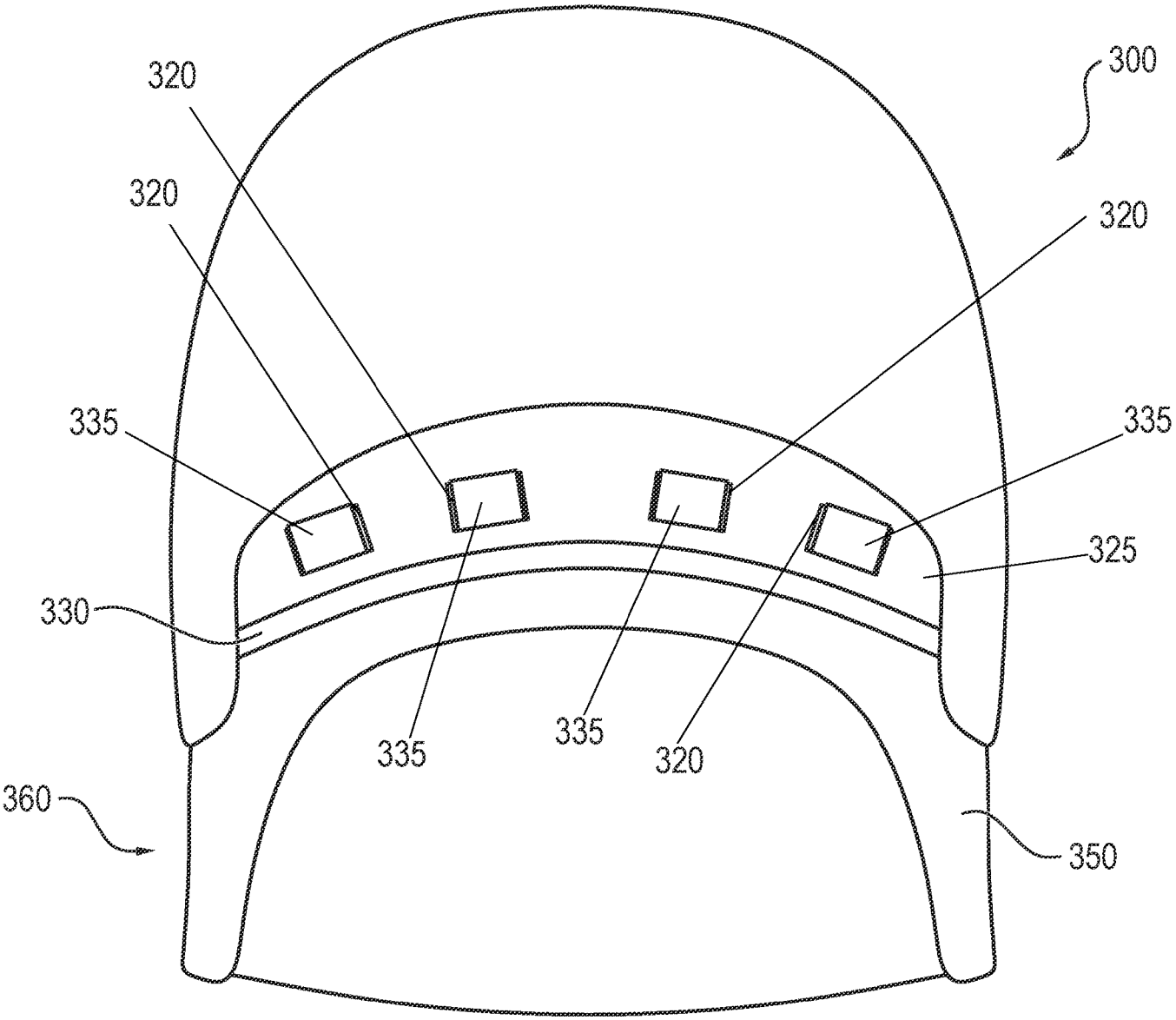
FIG. 3 is a schematic front view of a second exemplary embodiment of the head protection system according to the present invention.

FIG. 3 shows a schematic view of a second exemplary embodiment of the head protection system 300 according to the present invention.

The head protection system 300 differs from the head protection system shown in FIG. 1 and in FIG. 2 in that the textile part 350 of the fire protection cloth 360 is closed around the head in the manner of a tube and the fastening strap 330 is therefore a closed ring. In one exemplary embodiment, not shown, the fastening strap is an open strap, which can be connected into a ring shape via a connection piece, for example, by a Velcro fastener, a clamping connection, a zipper or another suitable positive-locking and/or non-positive connection. The fastening strap 330 has a plurality of fastening elements 335, which are configured each to mesh with a respective opening 320 of a fastening ring 325.

Figure 4:
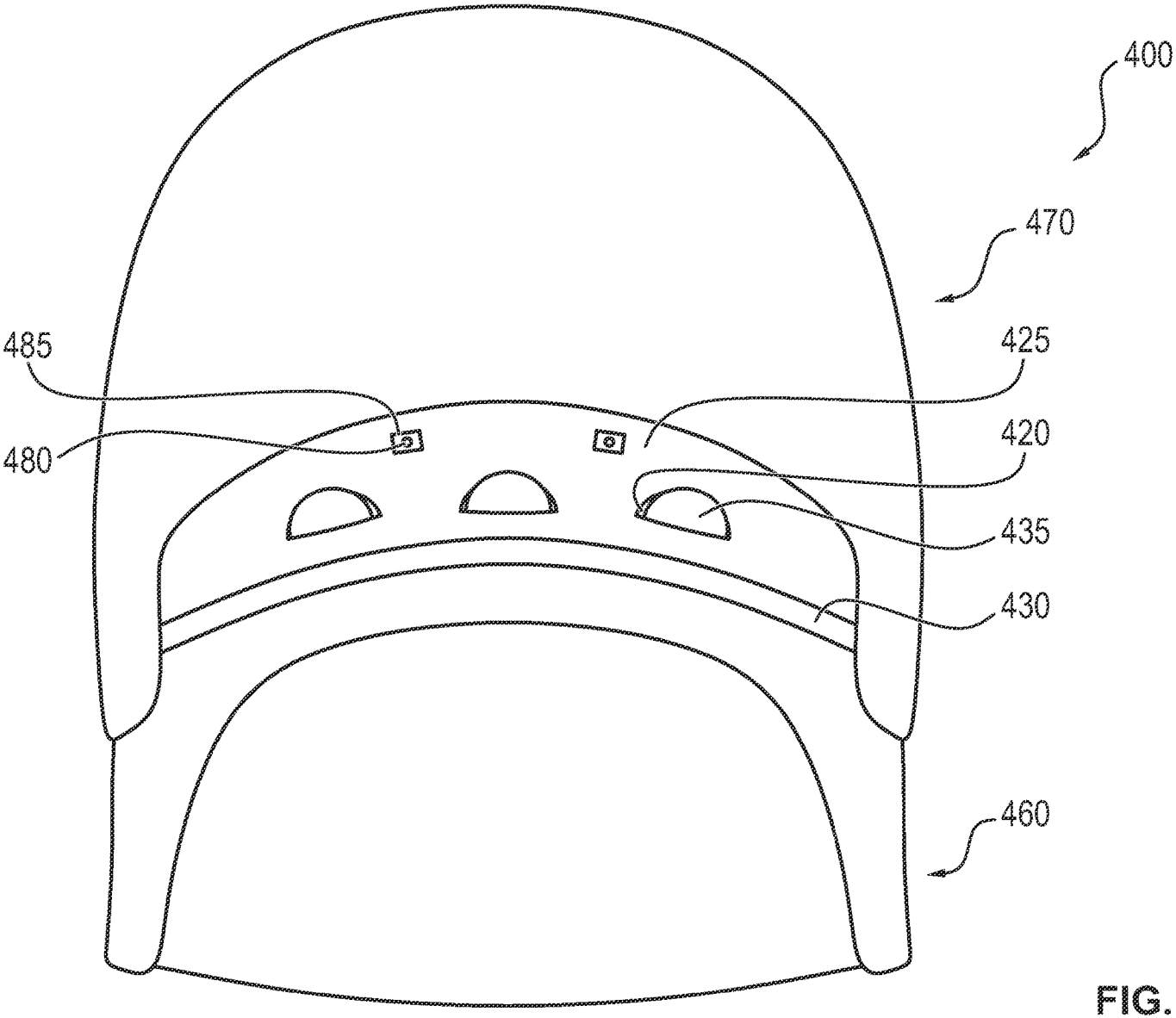
FIG. 4 is a schematic front view of a third exemplary embodiment of the head protection system according to the present invention.

FIG. 4 shows a schematic view of a third exemplary embodiment of the head protection system 400 according to the present invention.

The head protection system 400 differs from the head protection system 300 shown in FIG. 3 in that the rigid fastening elements 435 have a round, especially semicircular configuration. Furthermore, the fire protection cloth 460 has exactly three rigid fastening elements 435. The plurality of openings 420 have a semicircular configuration corresponding to the rigid fastening elements 435.

The fastening strap 430 of the fire protection cloth 460 is fastened at the fastening ring 425 of the safety helmet 470 via a latch mechanism. The latch mechanism is formed by the combination of rigid fastening elements 435 and by the corresponding openings 420. The latching takes place with this configuration via the respective projections (not shown) arranged at the three rigid fastening elements 435. Thus, there is a positive-locking connection and at the same time a non-positive connection between the fire protection cloth 460 and the safety helmet 470.

Further, the head protection system 400 differs from the head protection system 300 shown in FIG. 3 in that, in addition to the fastening via the rigid fastening elements, a plurality of fastening parts 480, via which the fire protection cloth 460 is additionally connected detachably to the safety helmet 470, are arranged at the fire protection cloth 460. The plurality of fastening parts 480 comprise two fastening parts, which are pressed from the inner side 406 of the helmet shell 405 against the fastening ring 425 in order to form a detachable connection between the fire protection cloth 460 and the safety helmet 470 with correspondingly configured counter-parts 485 of the fastening ring 425. The fire protection cloth 460 is connected to the safety helmet 470 especially reliably and securely due to this additional connection in the exemplary embodiment shown.

Figure 5:
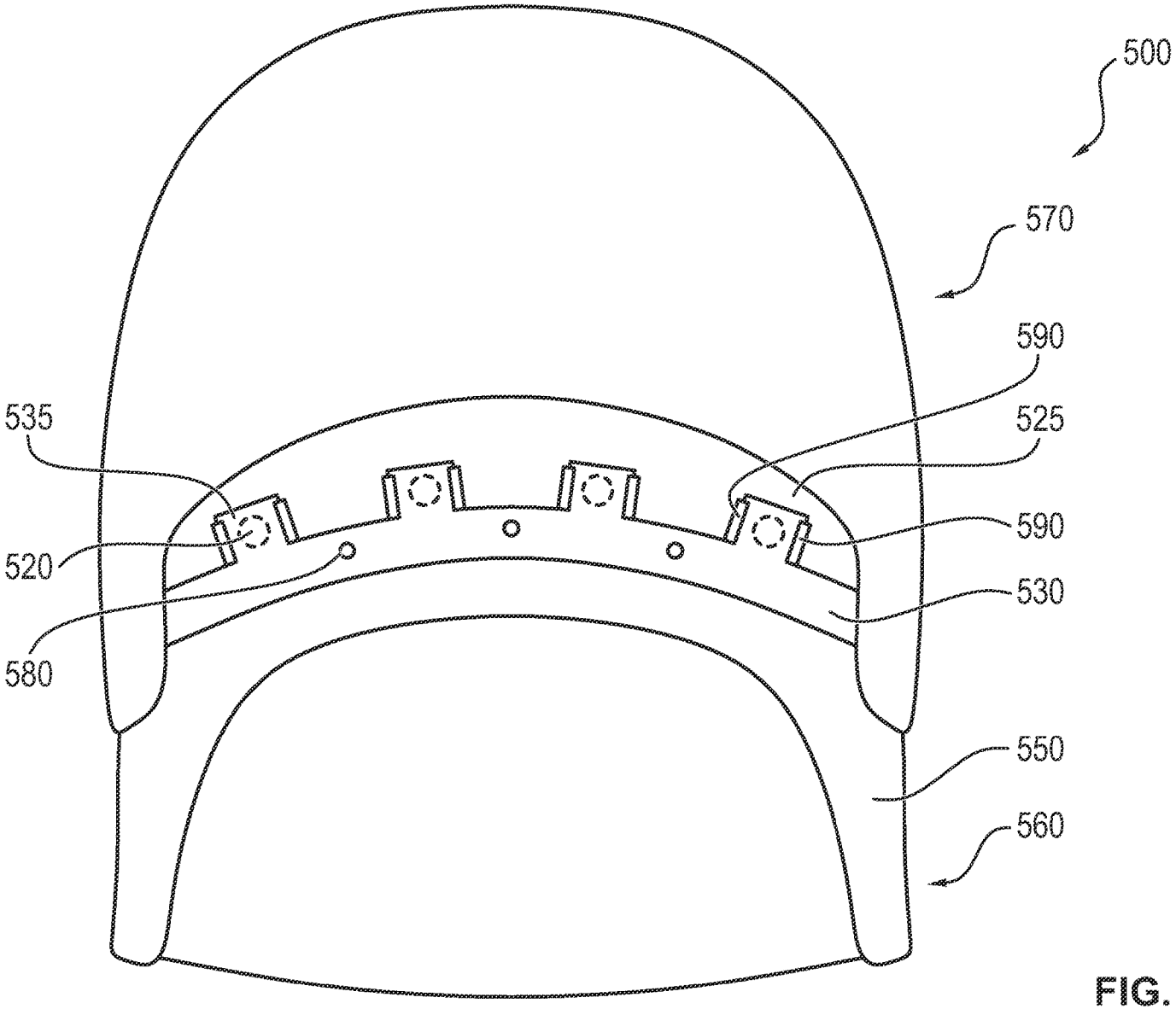
FIG. 5 is a schematic front view of a fourth exemplary embodiment of the head protection system according to the present invention.

FIG. 5 shows a schematic view of a fourth exemplary embodiment of the head protection system 500 according to the present invention.

The head protection system 500 differs from the head protection system 300 shown in FIG. 3 in that the fire protection cloth 560 is fastened in the fastened state on the side of the fastening ring 525, which side points away from the head of the user. The rigid fastening elements 535 of the fastening strap 530 are not passed here, unlike in the above-described exemplary embodiments, through a respective opening of the fastening ring 525. The rigid fastening elements 535 are held in the exemplary embodiment shown by means of a respective rail 590 at the fastening ring 525. An effective fastening against pulling forces acting on the fire protection cloth 560 is made possible by an additional fastening of the fire protection cloth 560 at the safety helmet 570 via corresponding fastening parts 580. These corresponding fastening parts 580 have projections, which are pressed and/or inserted through corresponding counter-parts (not shown) in the direction of the head. Other prior-art connections may also be used as an additional connection for fastening the fire protection cloth 560 at the safety helmet 570.

The plurality of openings 520 are closed completely in the fastened state of the fire protection cloth 560. In the exemplary embodiment shown, the air path between the safety helmet 570 and the head is closed completely by the closing according to the present invention of the plurality of openings 520. This is also achieved by the textile part 550 of the fire protection cloth 560, which is in contact with the head of the user in the area of the forehead. Complete closing of the openings by the fastening elements was likewise present in the preceding exemplary embodiments. In one exemplary embodiment, not shown, a respective opening of the fastening ring is closed only in part by the corresponding fastening element.

Unlike in the preceding exemplary embodiments, the shape of the plurality of openings 520 and the shape of the rigid fastening elements 535 are not identical in the head protection system 500. The rigid fastening elements 535 have a rectangular shape and the plurality of openings 520 have an oval shape. As a result, an especially reliable closing of the openings 520 by the rigid fastening elements 535 can be achieved hereby due to the rigid fastening elements 535.

While specific embodiments of the invention have been shown and described in detail to illustrate the application of the principles of the invention, it will be understood that the invention may be embodied otherwise without departing from such principles.

LIST OF REFERENCE CHARACTERS

100, 470, 570 Safety helmet
102 Head
105 Helmet shell
106 Inner side of the helmet shell
107 Outer side of the helmet shell
108 Holding device
110 Air path

112 Shock-absorbing element
114 Spacer element
120, 420, 520 Plurality of openings
125, 425, 525 Fastening ring
200, 360, 460, 560 Fire protection cloth
230, 330, 430, 530 Fastening strap
235, 435, 535 Rigid fastening element
237 Projection
240 Recess
250, 350 Textile part
300, 400, 500 Head protection system
480, 580 Plurality of fastening parts
485 Plurality of counter-parts
590 Rail
A Distance
B1 Width of opening
B2 Width of fastening element
H1 Height of opening
H2 Height of fastening element

What is claimed is:

1. A head protection system comprising:

a safety helmet comprising a helmet shell, a fastening ring and a holding device configured to provide a distance between an inner side of the helmet shell and the head of a user of the safety helmet in a state in which the safety helmet is being used, wherein an air path is formed between the safety helmet and the head based on the distance between the inner side of the helmet shell and the head of the user, the air path is formed in part by a plurality of openings of the fastening ring and the fastening ring being arranged at least in an area of the forehead of the user in the state in which the safety helmet is being used; and a fire protection cloth comprising a fastening strap with a plurality of rigid fastening elements configured to each mesh with a respective one of the openings of the fastening ring and to detachably fasten the fire protection cloth to the safety helmet, wherein the plurality of rigid fastening elements fill the plurality of openings in a fastened state of the fire protection cloth such that a flow of fluid through the plurality of openings is reduced.

2. A head protection system in accordance with claim 1, wherein the fastening strap is manufactured from a plastic.

3. A head protection system in accordance with claim 1, wherein the safety helmet further comprises a shock-absorbing element arranged on the inner side of the helmet shell; and the fastening ring is arranged at the shock-absorbing element.

4. A head protection system in accordance with claim 1, wherein the plurality of openings of the fastening ring comprises at least four openings.

5. A head protection system in accordance with claim 1, wherein the fastening strap of the fire protection cloth is fastened at the fastening ring of the safety helmet via a latching mechanism formed by the fastening elements and the openings.

6. A head protection system in accordance with claim 1, wherein the fastening elements form teeth at the fastening strap.

7. A head protection system in accordance with claim 1, wherein the fastening elements of the fastening strap have an essentially rectangular configuration.

8. A head protection system in accordance with claim 7, wherein the openings of the fastening ring have an essentially rectangular configuration corresponding to the configuration of the fastening elements.

9. A head protection system in accordance with claim 1, wherein the safety helmet is configured such that the air path between the safety helmet and the head is completely closed in a fastened state of the fire protection cloth.

10. A head protection system in accordance with claim 1, wherein:

the fastening strap further comprises a plurality of fastening parts configured to detachably fasten the fire protection cloth to the safety helmet; and the plurality of fastening parts is in addition to the plurality of rigid fastening elements.

* * * * *